US005392008A

United States Patent [19]

Wong

[11] Patent Number: 5,392,008

[45] Date of Patent: Feb. 21, 1995

[54] ORTHOMODE TRANSDUCER WITH SIDE-PORT WINDOW

[75] Inventor: Mon N. Wong, Torrance, Calif.

[73] Assignee: Hughes Aircraft Company, Los Angeles, Calif.

[21] Appl. No.: 50,791

[22] Filed: Apr. 22, 1993

[51] Int. Cl.[6] ..... H01P 1/16

[52] U.S. Cl. ..... 333/21 R; 333/121; 333/125

[58] Field of Search ..... 333/121, 122, 125, 137, 333/21 R

[56] References Cited

U.S. PATENT DOCUMENTS

| | | | |
|---|---|---|---|
| 4,498,062 | 2/1985 | Massaglia et al. | 333/135 |
| 4,758,806 | 7/1988 | Möhring et al. | 333/135 |
| 4,786,883 | 11/1988 | Spinner | 333/21 R |
| 4,797,681 | 1/1989 | Kaplan et al. | 343/786 |

OTHER PUBLICATIONS

"*Wide-Band Orthmode Transducers*" by Stephen J. Skinner and Graeme L. James, IEEE Transaction on Microwave Theory and Techniques vol. 39 No. 2, Feb. 1991, pp. 295–297.

*Primary Examiner*—Robert J. Pascal
*Assistant Examiner*—Darius Gambino
*Attorney, Agent, or Firm*—Terje Gudmestad; Wanda K. Denson-Low

[57] ABSTRACT

A dual mode waveguide orthomode transducer has a section of circular waveguide (12) and a transition (16) from circular waveguide to rectangular waveguide disposed coaxially along a longitudinal axis (38). A terminus of the transition (16) opposite the circular waveguide (12) serves as a straight port (46) for input signals, and at the opposite end of the circular waveguide there is a front port (14) for outputting electromagnetic signals. A side port (48) connects via a tapered rectangular waveguide (40) perpendicularly to the longitudinal axis (38) to connect with the circular waveguide (12), and to couple electromagnetic energy into the circular waveguide (12) via a window (50) disposed in a sidewall (42) of the circular waveguide. A plane of polarization of a wave in one input port is perpendicular to a plane of polarization of a wave in the other input port. A plurality of vanes of differing widths (66, 68) is disposed in the tapered rectangular waveguide (40), the blades being parallel to broad walls of the rectangular waveguide. The blades (66, 68) are electrically conductive. Additional electrically conductive blades (60, 62) are disposed along the longitudinal axis 38 parallel to broad walls of the straight port (46) and are located between a center of the window (50) and the back end of the circular waveguide (12). A third blade (64) of electrically resistive material is located in the region of an interface between the circular waveguide and the transition.

15 Claims, 1 Drawing Sheet

FIG. 1.
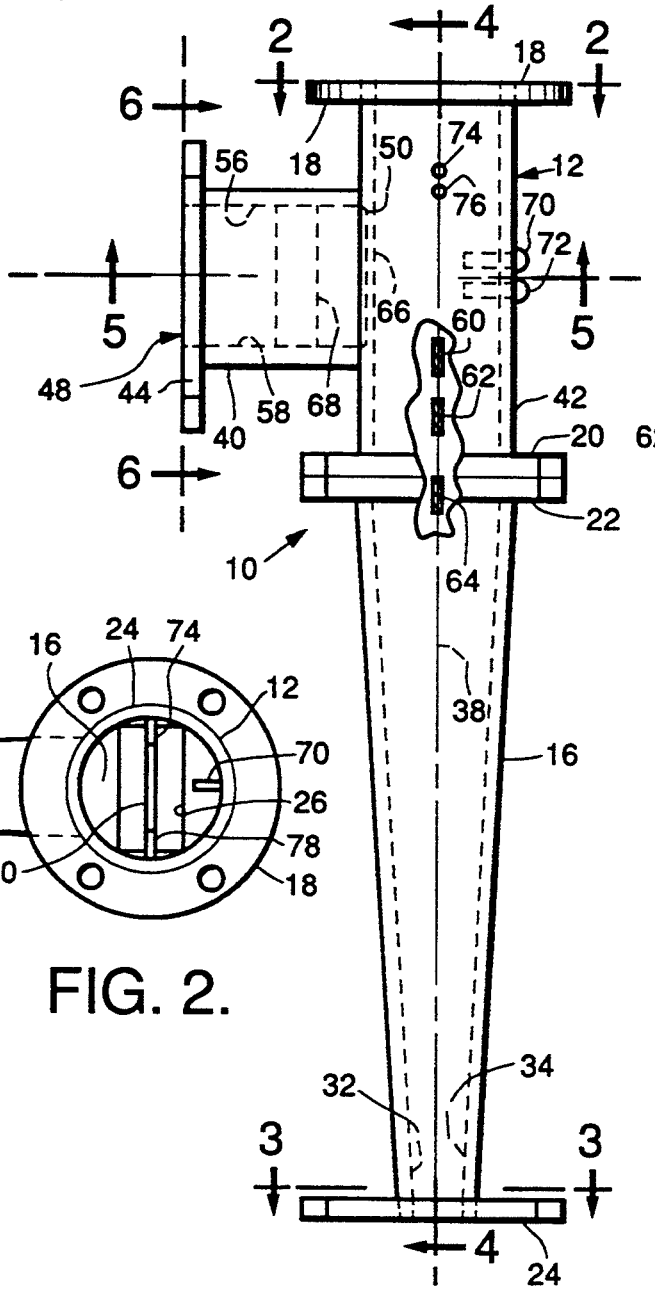
FIG. 4.
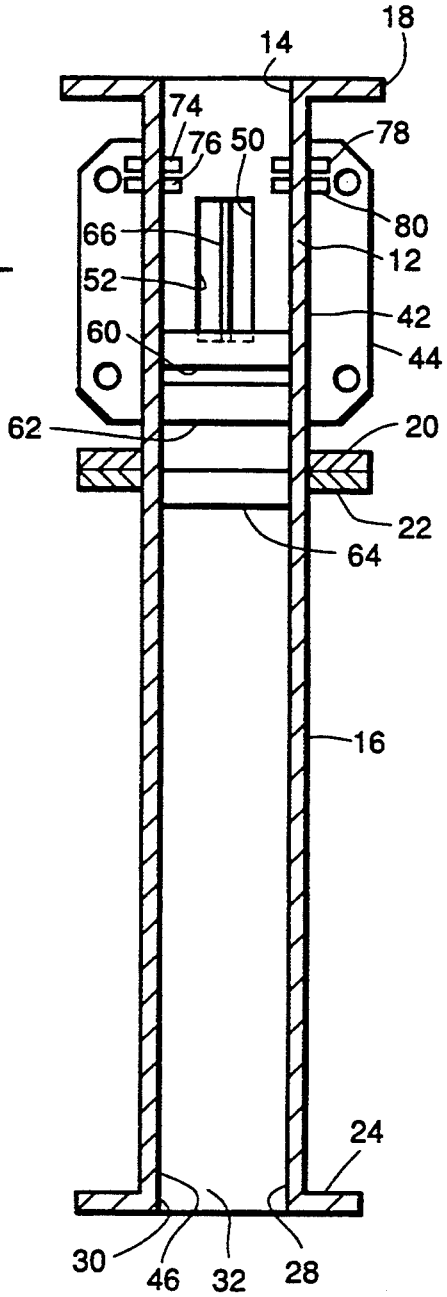
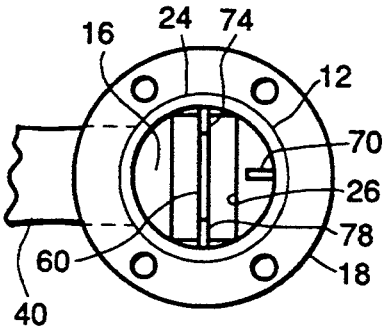
FIG. 2.
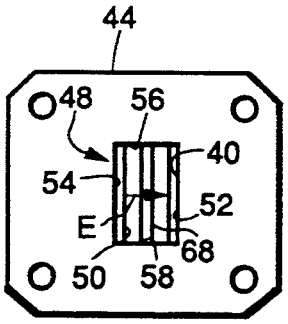
FIG. 6.
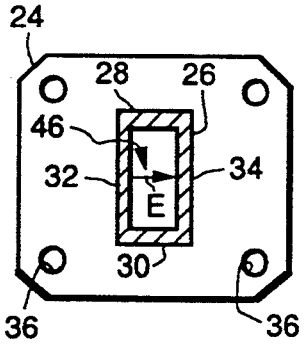
FIG. 3.
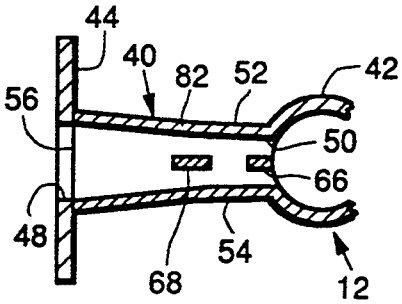
FIG. 5.

ORTHOMODE TRANSDUCER WITH SIDE-PORT WINDOW

BACKGROUND OF THE INVENTION

This invention relates to microwave orthomode transducers for concurrent transmission of electromagnetic signals of differing polarizations and, more particularly, to an orthomode transducer having a straight port communicating with a circular waveguide section via a tapered transition, a side port communicating via a window with the circular waveguide section, and a system of blade-shaped cross-polarization suppressors allowing for increased bandwidth.

Orthomode transducers are widely used in communication systems, including satellite communication systems, because of their capacity to provide for a concurrent transmission of signals of differing frequencies and differing polarizations through a common microwave port suitable for connection to antenna or other device. In a typical construction of orthomode transducer, the transducer includes a waveguide section of circular cross section having an output port which may be coupled to an antenna, by way of example, and further comprising two waveguides of rectangular cross-sectional configuration communicating with the circular waveguide section. The two rectangular waveguides serve as input ports to the transducer, and are arranged relative to each other for applying two electromagnetic waves of linear polarization to the circular waveguide wherein the polarization from the first rectangular waveguide is perpendicular, or orthogonal, to the polarization from the second rectangular waveguide. The transducer operates in reciprocal fashion such that the output port may receive plural signals from an antenna wherein signals of one polarization are coupled to the first rectangular waveguide and signals of an orthogonal polarization are coupled to the second rectangular waveguide. The signals may be provided at different carrier frequencies, such as up-link and down-link signals between a satellite and the earth. Alternatively, signals of the two rectangular waveguides may be provided at a common frequency in which case the orthogonally polarized waves combine in the circular waveguide section to provide a single output signal having either a linear, elliptical, or circular polarization depending on the relative magnitudes and phases of the signals in the two rectangular waveguides.

A problem arises in that presently available orthomode transducers are limited in the bandwidth of signals that can be coupled between the rectangular waveguides and the circular waveguide section. This, in turn, provides a limitation upon the spectral content of signals to be communicated via the transducer in a communication system. Also, in satellite communication systems, an overly large physical size of the transducer may provide difficulties in the packaging of microwave equipment to be carried by the satellite. Thus, there is a need to increase the bandwidth of orthomode transducers, as well as to decrease the physical size.

SUMMARY OF THE INVENTION

The aforementioned problem is overcome and other advantages are provided by an orthomode transducer comprising a waveguide section of circular cross section and providing a circular output port, a first rectangular waveguide input port, and a second rectangular waveguide input port. In accordance with the invention, the first rectangular waveguide input port is arranged coaxially to the circular waveguide section, and is coupled thereto via a tapered transition. The second rectangular waveguide input port connects via a rectangular waveguide having tapered sidewalls to a sidewall of the section of circular waveguide, and communicates with the circular waveguide by a window extending the full distance between top and bottom walls and between opposed sidewalls of the rectangular waveguide. The planar polarization of a linearly polarized wave in the first input port is perpendicular to a planar polarization of a linearly polarized wave propagating through the second input port. The use of a coupling window, rather than a coupling slot, at the interface between the rectangular waveguide and the circular waveguide, provides for increased bandwidth for signals coupled between the input ports and the circular waveguide. The use of the waveguide taper between the first input port and the circular waveguide provides for a reduction in overall length of the transducer.

In order to operate the transducer over a broad bandwidth, and to ensure that there is essentially no cross coupling of the orthogonally polarized waves of the two input ports, a first system of cross-polarization suppressors is employed along the axis of the circular waveguide, and a second system of cross-polarization suppressors is employed along the axis of the rectangular waveguide connecting between the second input port and the circular waveguide. The second cross-polarization suppressor system comprises two blades of electrically conductive material, such as aluminum or copper, oriented perpendicularly to the plane of polarization of the electromagnetic wave propagating through the second input port. The first cross-polarization suppressor system comprises three blades which are oriented in a plane perpendicular to the plane of polarization of the electromagnetic wave propagating through the first input port. In the circular waveguide, the first two blades, closest to the output port, are fabricated of electrically conductive material, such as aluminum or copper, and the third blade is located at the interface with the tapered waveguide and is fabricated of electrically resistive material. A single pair of tuning screws is disposed in the sidewall of the circular waveguide opposite the window and coplanar with the blades within the rectangular waveguide. Two opposed pairs of tuning screws are disposed in the sidewall of the circular waveguide and are coplanar with the blades in the circular waveguide, the two opposed pairs of tuning screws being disposed slightly forward of the window towards the output port of the transducer.

BRIEF DESCRIPTION OF THE DRAWING

The aforementioned aspects and other features of the invention are explained in the following description, taken in connection with the accompanying drawing wherein:

FIG. 1 is a plan view of the transducer of the invention, a portion of the figure being cut away to show blades of a cross-polarization suppressor system disposed in a circular waveguide of the transducer;

FIG. 2 is an end view of the transducer, taken along the line 2—2 in FIG. 1, the view showing an output port of the transducer;

FIG. 3 is a sectional view, taken along the line 3—3 of FIG. 1, showing a first rectangular input port, or straight port, of the transducer;

FIG. 4 is a longitudinal sectional view of the transducer, taken along the line 4—4 of FIG. 1;

FIG. 5 is a transverse sectional view, taken along the line 5—5 of FIG. 1, the view showing a fragmentary portion of the transducer including a tapered rectangular waveguide connecting a second input port, or side port, to the circular waveguide section of the transducer; and FIG. 6 is an end view, taken along the line 6—6 of FIG. 1, showing the second input port or side port, of the transducer.

DETAILED DESCRIPTION

With reference to the drawing figures, an orthomode transducer 10 comprises a section of circular waveguide 12 having a front port 14 located at a front end of the waveguide 12 to serve as an output port of the transducer 10, and a transition 16 from circular waveguide to rectangular waveguide connected to a back end of the circular waveguide 12. The front end of the circular waveguide 12 is provided with a circular flange 18 for connection with the utilization device, such as an antenna (not shown), and with a circular flange 20 at the back end of the circular waveguide 12. The transition 16 is provided with a circular flange 22 at a front end of the transition 16, and with a rectangularly shaped flange 24 at the back end of the transition 16. The transition 16 is joined to the circular waveguide 12 by means of the flanges 22 and 20. The front end of the transition 16 has a circular cross section, and the back end of the transition 16 is configured as a rectangular waveguide 26. The waveguide 26 serves as a first input port, or straight port, of the transducer 10, and comprises two opposed sidewalls 28 and 30 joined by broad walls 32 and 34. The waveguide 26 is encircled by the back flange 24. The flange 24 is provided with apertures 36 for receiving screws (not shown) by which connection is made between the flange 24 and, by way of example, a device such as a source electromagnetic power (not shown) external to the transducer 10. The circular waveguide 12 and the transition 16 are disposed coaxially about a longitudinal axis 38 of the transducer 10.

The transducer 10 further comprises a rectangular waveguide 40 communicating with the circular waveguide 12, and extending from a sidewall 42 of the circular waveguide 12 radially outward to terminate at a second input port, or side port, of the transducer 10, the rectangular waveguide 40 being provided with a flange 44 at the location of the side port. The two input ports, namely, the straight port 46 and the side port 48, may be coupled by their respective flanges 24 and 44 to sources of electromagnetic energy (not shown) as has been described above for the straight port 46. It is to be noted that the transducer 10 operates in reciprocal fashion such that input electromagnetic power may be applied at the front port 14 and outputted at the straight port 46 and the side port 48, in which case the straight port 46 and the side port 48 would be connected to microwave receivers (not shown).

In view of the reciprocal operational characteristic of the transducer 10, it is to be understood that the terms input port and output port are to be employed as a convenience in describing the operation of the transducer 10, and that any one of the ports can function as either an input port or an output port.

In accordance with the invention, the transducer 10 comprises a window 50 disposed in the sidewall 42 of the circular waveguide 12 for communicating electromagnetic power between the circular waveguide 12 and the rectangular waveguide 40. The window 50 is bounded by opposed broad walls 52 and 54 and opposed sidewalls 56 and 58 of the rectangular waveguide 40 to maximize bandwidth in the coupling of electromagnetic power between the waveguides 12 and 40. In the rectangular waveguide 26 connecting with the straight port 46, the broad walls 32 and 34 each have a width equal to approximately twice the width of either of the narrower sidewalls 28 and 30 (FIG. 3). The electric field, E, of an electromagnetic wave propagating through the straight port 46 and the rectangular waveguide 26 is parallel to the sidewalls 28 and 30 and perpendicular to the broad walls 32 and 34. Similarly, in the rectangular waveguide 40 connecting with the side port 48, the broad walls 52 and 54 each have a width equal to approximately twice the width of either of the sidewalls 56 and 58 (FIG. 6). The electric field, E, of an electromagnetic wave propagating through the side port 48 and the rectangular waveguide 40 is oriented parallel to the sidewalls 56 and 58 and perpendicular to the broad walls 52 and 54. The plane of polarization of the wave propagating through the straight port 46 is perpendicular to the plane of polarization of the wave propagating through the side port 48. In order to reduce cross coupling between the waves of the side port and the straight port, in accordance with a feature of the invention, the side walls 56 and 58 of the rectangular waveguide 40 are tapered from the side port 48 to a reduced width at the site of the window 50 (FIG. 5).

Further, in accordance with the invention, there is provided a cross-polarization suppressor system comprising blades 60, 62, and 64 disposed on the axis 38 within the circular waveguide 12 and the transition 16, and an additional cross polarization suppressor system comprising two blades 66 and 68 disposed within the rectangular waveguide 40. The blades 60 and 62 extend diametrically across the circular waveguide 12, and the blade 64 extends diametrically across the transition 16. The blades 60, 26 and 64 are disposed in a plane parallel to the broad walls 32 and 34 and perpendicular to the plane of polarization of the electromagnetic wave at the straight port 46. In the waveguide 40 connecting to the side port 48, the blades 66 and 68 are disposed along a central axis of the waveguide 40 in a plane parallel to the broad walls 52 and 54, and extend between the opposed sidewalls 56 and 58. The blades 60, 62, 66, and 68 are all fabricated of an electrically conductive material, a metal such as copper or aluminum being employed in the construction of the preferred embodiment of the invention. However, the blade 64 is fabricated of an electrically resistive material, such as a card of ceramic or glass with graphite particles therein. The blade 60 overlaps an edge of the window 50, the blade 62 is located between the window 50 and the flange 20, and the blade 68 is located at the interface of the transition 16 with the waveguide 12. The blade 66 is located within the window 50 and the blade 68 is located between the window 50 and the flange 44.

The transducer 10 further comprises a pair of tuning screws 70 and 72 secured to the sidewall 42 of the waveguide 12, and disposed coplanar with the blades 66 and 68. The screws 70 and 72 extend inwardly from the sidewall 42 towards the window 50. A further pair of tuning screws 74 and 76 are secured to the sidewalls 42 in side-by-side relation, and an additional pair of tuning screws 78 and 80 are mounted to the sidewall 42 diametrically opposite the locations of the tuning screws 74 and 76, The tuning screws 74, 76, 78, and 80 are disposed coplanar with the blades 60, 62, and 64, and are located slightly forward of the window 50. The tuning screws 70–80 serve to broaden the bandwidth in the spectral response of the transducer 10. Also, the spacing and dimensions of the blades 60–68 serve to broaden the bandwidth of the transducer 10.

The following dimensions are employed in construction of a transducer 10 in accordance with a preferred embodiment of the invention operative over a frequency band of 10.5 GHz (gigahertz) to 14.5 GHz. The two input ports 46 and 48 have the dimensions of the standard WR-75 waveguide, the interior dimensions measuring 0.375 inches by 0.750 inches. The front port 14 has an inside diameter of 0.692 inches. The overall length of the transducer 10, from the front port 14 to the straight port 46 is approximately 5.5 inches. The overall width of the transducer 10, from the side port 48 to the opposite side of the circular waveguide 12 is approximately 2.0 inches. The overall length of the transition 16 is 3.5 inches, this being approximately 3.7 free-space wavelength at the center of the operating band of the transducer 10. The overall length of the circular waveguide 12 is 2.0 inches with the waveguide 40 being centered on the waveguide 12. This gives approximately 1.06 free-space wavelengths between the center of the window 50 and either end of the circular waveguide 12. The waveguide 40, as measured from the side port 48 to the outside surface of the sidewall 42 has a length of 0.844 inches, this being approximately 0.894 free-space wavelengths. With respect to the tapering of the sidewalls 56 and 58 of the waveguide 40, the taper extends from the straight port 46 to a point 82 (FIG. 5) which is located 0.6 inches from the outside surface of the flange 44, after which the taper terminates and the remaining portions of the opposed broad walls 52 and 54 are parallel. The taper angle of the broad wall 52 is 4 degrees and 17 minutes relative to a transverse central plane of the waveguide 40, the same taper angle being employed for the opposite broad wall 54. The spacing between the broad walls 52 and 54 at the window 50 is 0.285 inches, this being equal to 0.302 free-space wavelengths. The spacing between the broad walls 52 and 54 at the flange 44 is 0.375 inches.

The following dimensions are employed in the construction of the blades and the tuning screws. The blade 60 has a depth of 0.032 inch and a width of 0.2 inch, the front edge thereof being set back from the center line of the waveguide 40 by a distance of 0.215 inch. The blade 62 has the same dimensions as the blade 60, and the front edge of the blade 62 is set back from the center line of the waveguide 40 by a distance of 0.58 inches. The blade 64 is fabricated as a resistance card having 100 ohms resistance, and has a thickness of 0.32 inches and a width of 0.15 inches. The front edge of the blade 64 is located at the interface between the flanges 20 and 22, this being a distance of 1.0 inches from the center line of the waveguide 40. The blade 66 has a thickness of 0.063 inch and a width of 0.050 inch, the inner edge thereof being flush with the inner surface of the circular sidewall 42. The blade 68 has a thickness of 0.063 inch and a width of 0.264 inch. The center of the blade 68 is located in a common transverse plane with the point 82 designating the end of the tapered portion of the waveguide 40. In the foregoing description of the blades 60–68, the dimension of width of the blades 60–64 is measured along the axis 38, and the width of each of the blades 66 and 68 is measured along the dimension of a longitudinal axis of the waveguide 40. The tuning screws 70 and 72 are disposed on opposite sides of the center line, or longitudinal axis, of the waveguide 40, each of the screws 70 and 72 being size 2–56. Each of the four tuning screws 74–80 has a size 0–80. Each of the tuning screws 70–80 extends into the circular waveguide 12 by a distance of approximately ⅛ free-space wavelength. The precise location of each tuning screw and its penetration into the circular waveguide 12 may be determined experimentally to optimize specific frequency characteristics desired for the orthomode transducer 10.

In the operation of the transducer 10, the three blades 60, 62, and 64 and the four screws 74, 76, 78, and 80 are essentially transparent to the electromagnetic wave propagating through the straight port 46. The two tuning screws 70 and 72 are essentially transparent to the electromagnetic wave propagating through the side port 48. With respect to the wave propagating through the side port 48, propagation of the wave towards the transition 16 is impeded by the two blades 60 and 62 and, furthermore, any electromagnetic power in that wave which propagates beyond the two blades 60 and 62 is absorbed by the resistance card of the blade 64. The extra width of the blade 68 in the waveguide 40 tends to lower the low-frequency end of the operating band while the reduced width of the blade 66 in the waveguide 40 tends to increase the high-frequency end of the operating band of the transducer 10.

By virtue of the foregoing construction, the orthomode transducer of the invention is provided with increased operating bandwidth and a reduction in overall size, as compared to previously-known orthomode transducers.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A waveguide orthomode transducer comprising:

a first rectangular input port having cross-sectional dimensions of width and height wherein the width is greater than the height;

a second rectangular input port having cross-sectional dimensions of width and height wherein the width is greater than the height;

an output port of circular cross section;

a circular waveguide extending along a central longitudinal axis of the transducer from said output port partway to said first input port;

a tapered transition from rectangular waveguide to circular waveguide connecting said circular waveguide to said first input port;

a rectangular waveguide connecting said second input port with said circular waveguide, a central axis of said rectangular waveguide being perpendicular to said longitudinal axis, said rectangular waveguide comprising a pair of opposed broad walls interconnected by a pair of opposed narrow walls;

wherein said first input port launches a first electromagnetic wave having a first linear polarization into said transition, an electric field of said first electromagnetic wave being parallel to sidewalls of said first input port;

wherein said second input port launches a second electromagnetic wave having a second linear polarization into said circular waveguide, a plane of polarization of said first electromagnetic wave being perpendicular to a plane of polarization of said second electromagnetic wave, an electric field of said second electromagnetic wave being parallel to sidewalls of said second input port;

said orthomode transducer further comprises a window disposed at a junction of said rectangular waveguide with said circular waveguide, said window extending from one of said broad walls to the other of said broad walls of said rectangular waveguide; and said transducer further comprises first blade means disposed along said longitudinal axis in said circular waveguide, and being perpendicular to the plane of polarization of said first electromagnetic wave.

2. A transducer according to claim 1 wherein sidewalls of said rectangular waveguide are tapered between a maximum height at said second input port to a minimum height at said window.

3. A transducer according to claim 2 wherein a tapering of said sidewalls extends from said second input port to a central portion of said rectangular waveguide, with the sidewalls having a constant height from said central portion of said rectangular waveguide to said window.

4. A transducer according to claim 1 further comprising second blade means disposed in said rectangular waveguide along an axis of said rectangular waveguide, and being perpendicular to a plane of polarization of said second electromagnetic wave.

5. A transducer according to claim 4 wherein a center of said window is located between said first blade means and said output port.

6. A transducer according to claim 5 wherein sidewalls of said rectangular waveguide are tapered between a maximum height at said second input port to a minimum height at said window.

7. A transducer according to claim 6 wherein said first blade means comprises two coplanar blades spaced apart from each other.

8. A transducer according to claim 7 wherein said second blade means comprises two coplanar blades spaced apart from each other.

9. A transducer according to claim 8 wherein said two coplanar blades of said first blade means are constructed of electrically conductive material, said two coplanar blades of said second blade means are constructed of electrically conductive material, and wherein said first blade means further comprises a third blade of electrically resistive material located in the region of an interface between said circular waveguide and said tapered transition.

10. A transducer according to claim 9 wherein, in said second blade means, one of said blades has a larger width and the other of said blades has a smaller width, the blade of larger width being located in a central region of said rectangular waveguide and the blade of narrower width being located at said window.

11. A transducer according to claim 10 wherein, in said first blade means, said two blades of electrically conductive material are located between a center of said window and said third blade.

12. A transducer according to claim 1 wherein said first blade means comprises two coplanar blades spaced apart from each other and located on said longitudinal axis of said circular waveguide;

said two coplanar blades of said first blade means are constructed of electrically conductive material, said two coplanar blades of said second blade means are constructed of electrically conductive material, and wherein said first blade means further comprises a third blade of electrically resistive material located in the region of an interface between said circular waveguide and said tapered transition; and in said first blade means, said two blades of electrically conductive material are located between a center of said window and said third blade.

13. A transducer according to claim 1 further comprising second blade means disposed in said rectangular waveguide along an axis of said rectangular waveguide, and being perpendicular to a plane of polarization of said second electromagnetic wave;

said second blade means comprises two coplanar blades spaced apart from each other and located along said axis of said rectangular waveguide; and in said second blade means, one of said blades has a larger width and the other of said blades has a smaller width, the blade of larger width being located in a central region of said rectangular waveguide and the blade of narrower width being located at said window.

14. A transducer according to claim 13 wherein a center of said window is located between said first blade means and said output port.

15. A waveguide orthomode transducer comprising:

a first rectangular input port having cross-sectional dimensions of width and height wherein the width is greater than the height;

a second rectangular input post having cross-sectional dimensions of width and height wherein the width is greater than the height;

an output port of circular cross section;

a circular waveguide extending along a central longitudinal axis of the transducer from said output port partway to said first input port;

a tapered transition from rectangular waveguide to circular waveguide connecting said circular waveguide to said first input post;

a rectangular waveguide connecting said second input port with said circular waveguide, a central axis of said rectangular waveguide being perpendicular to said longitudinal axis, said rectangular waveguide comprising a pair of opposed broad walls interconnected by a pair of opposed narrow walls;

wherein said first input port launches a first electromagnetic wave having a first linear polarization into said transition, an electric field of said first electromagnetic wave being parallel to sidewalls of said first input port;

wherein said second input port launches a second electromagnetic wave having a second linear polarization into said circular waveguide, a plane of polarization of said first electromagnetic wave being perpendicular to a plane of polarization of said second electromagnetic wave, an electric field of said second electromagnetic wave being parallel to sidewalls of said second input port;

said orthomode transducer further comprises a window disposed at a junction of said rectangular waveguide with said circular waveguide, said window extending from one of said broad walls to the other of said broad walls of said rectangular waveguide;

sidewalls of said rectangular waveguide are tapered between a maximum height at said second input port to a minimum height at said window, a tapering of said sidewalls extends from said second input port to a central portion of said rectangular waveguide, with the sidewalls having a constant height from said central portion of said rectangular waveguide to said window; and said transducer further comprises blade means disposed within said rectangular waveguide between said central portion of said rectangular waveguide and said window.

* * * * *